United States Patent [19]

Long

[11] 4,190,022

[45] Feb. 26, 1980

[54] FUEL INJECTION SYSTEM WITH CORRECTION FOR INCIDENTAL SYSTEM VARIABLES

[75] Inventor: E. David Long, Elmira, N.Y.

[73] Assignee: Allied Chemical Corporation, Morris Township, Morris County, N.J.

[21] Appl. No.: 872,412

[22] Filed: Jan. 26, 1978

Related U.S. Application Data

[63] Continuation of Ser. No. 629,353, Nov. 6, 1975, abandoned.

[51] Int. Cl.[2] ..... F02B 3/00

[52] U.S. Cl. ..... 123/32 EF; 361/139

[58] Field of Search ..... 123/32 CA, 32 EF; 317/DIG. 4, DIG. 6

[56] References Cited

U.S. PATENT DOCUMENTS

| | | | |
|---|---|---|---|
| 3,114,872 | 12/1963 | Allard | 317/DIG. 4 |
| 3,243,665 | 3/1966 | Fayer | 317/DIG. 4 |
| 3,246,233 | 4/1966 | Herz | 317/DIG. 4 |
| 3,293,505 | 12/1966 | Miller | 317/DIG. 4 |
| 3,700,985 | 10/1972 | Applequist | 317/DIG. 4 |
| 3,740,615 | 6/1973 | Vibini | 317/DIG. 4 |
| 3,786,344 | 1/1974 | Davis | 123/32 CA |

FOREIGN PATENT DOCUMENTS

| | | | |
|---|---|---|---|
| 262271 | 2/1970 | U.S.S.R. | 317/DIG. 4 |

*Primary Examiner*—Ronald B. Cox

*Attorney, Agent, or Firm*—Patrick L. Henry; Paul T. Kashimba; Ernest D. Buff

[57] ABSTRACT

A fuel injection system employs injectors having energizing coils and means for generating an actuating pulse to the injector. The system includes a correction means for applying a correction to the injector actuaing pulse to correct for the effect of at least one incidental system variable on the effective response of the injector to the actuating pulse. The incidental system variables are: the impedance of the energizng coil, the specific resistance of the wire used in the coil and the voltage supply in the fuel injection system. The correction means may be a constant current source drivng an output transistor biased to operate in a proportional conduction region.

2 Claims, 3 Drawing Figures

FUEL INJECTION SYSTEM WITH CORRECTION FOR INCIDENTAL SYSTEM VARIABLES

This is a continuation of application Ser. No. 629,353, filed Nov. 6, 1975, now abandoned.

BACKGROUND OF THE INVENTION

1. Field of the Invention

This invention relates to electronic circuitry for actuating fuel injection valves in timed relation to the operation of the engine, and more particularly to a means to correct for incidental variable to the fuel injection system. This invention may be used in a system such as that described in my U.S. patent application Ser. No. 629,421, entitled "Fuel Injection System" and in my U.S. Pat. No. 4,058,709 issued Nov. 15, 1977, entitled "Control Computer for Fuel Injection System," both filed concurrently herewith.

2. Prior Art

Fuel injection systems, employing electrically actuated injector valves to provide metered quantities of fuel to the individual engine cylinders, were originally proposed as devices for improving an engine's performance. In recent years, these systems have received renewed interest because of the prospect of minimizing the polluting components of the engine's emissions. By providing each cylinder with a more precise quantity of fuel as determined by measurements of engine operating parameters, they insure a more complete combustion of the fuel charge. This metering requires a measurement of a variety of engine operating parameters including manifold pressure, engine temperature, engine speed, barometric pressure and the like. Relatively complex "computers" have been developed which receive all of these measurements and adjust the width of an actuating pulse to the coils of the fuel injectors to actuate the injectors for a controlled time to meter the required fuel quantity.

One source of inaccuracy in such systems has resulted from incidental system variables, such as impedance variations of the injector solenoid coils, specific resistance of the wire used in the individual coils of different injectors and the voltage supply to the fuel injection system. The coils are positioned close to the engine. As a result their temperature and hence their resistance will vary between extremes ranging from a low when the engine starts cold in the winter and a high associated with normal engine operation. A temperature range from −20° F. to 300° F. is not unusual for the injector coils. Such a variation in temperature will cause a wide variation in coil resistance.

Previous injector circuits have employed switched outputs which provide a substantially constant voltage source and provide the solenoid coils with current inversely proportional to their resistance. Thus, the current to the coil, and the actuation force of the coil, would vary with the engine temperature. The response time required for the injector to actuate after the start of an actuating pulse is in turn a function of the current applied to the coil. Accordingly, this response time varies with engine temperature and limits the accuracy with which fuel can be metered by the system.

SUMMARY OF THE INVENTION

The present invention is broadly directed toward means for applying a correction to the injector actuating pulse to correct for the effect of at least one incidental system variable on the effective response of the injector to the actuating pulse. The incidental system variables are: the impedance of the coil, the specific resistance of the wire used in the coil and the voltage supply to the fuel injection system such as that derived from the battery. As a result, variations in response time of the injector with engine temperature have been substantially reduced. In a preferred embodiment of the invention, which will subsequently be described in detail, such correction is achieved by driving the injector valve solenoid coil with a constant current source switched into and out of a proportionately conductive mode by an output signal of a variable width pulse generator responsive to engine operating parameters. The constant current source includes an output transistor having the injector coil connected in its collector circuit and having its base driven by a switchable constant current input to the transistor. When the variable width pulse occurs and the current source is provided to its base, the transistor operates in a proportionately conductive mode, with its collector current being substantially independent of injector coil resistance. That is, the collector current is a function of base current but is substantially independent of collector load resistance. As the slope of the output transistor collector load line changes with variations in the impedance of the injector coil, the collector to emitter voltage inherently varies to maintain the collector current substantially constant. The constant current input to the base of the output transistor is supplied by an emitter follower having its input current stabilized by a Zener diode.

The constant current circuit of the present invention is simple, reliable and renders the response time of the injector valves substantially independent of engine temperature and the incidental variables to allow more precise metering of the engine fuel. Other objectives, advantages and applications of the invention will be made apparent by the following detailed description of a preferred embodiment of the invention. The description makes reference to the accompanying drawings.

DETAILED DESCRIPTION

Figure 1:
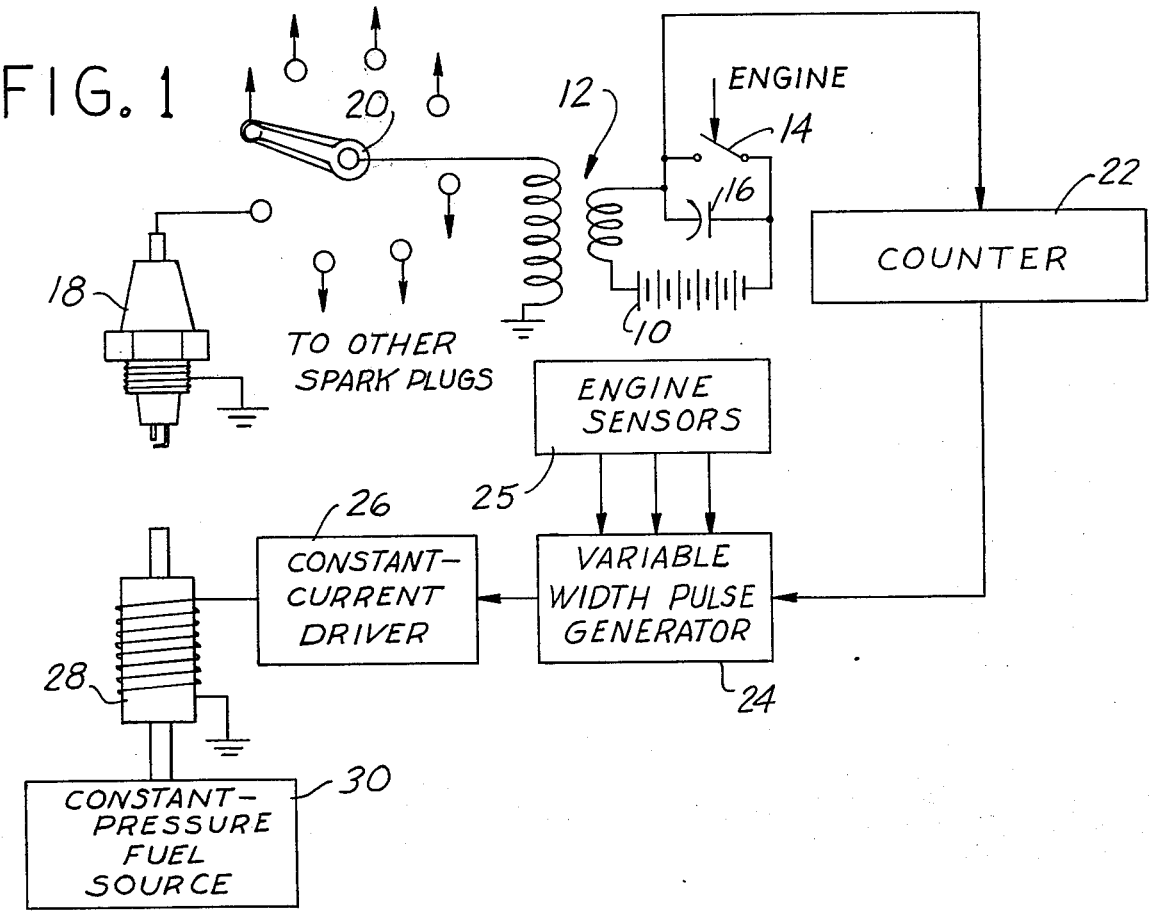
FIG. 1 is a block diagram of a fuel injection and ignition system for an engine using my invention.

Referring to the drawings, FIG. 1 illustrates an ignition and fuel injection system for one cylinder of a multi-cylinder internal combustion, spark-ignited engine. The vehicle battery 10 is connected to the primary of a spark coil 12 through breaker points 14 shunted by a capacitor 16. The breaker points are opened in timed relation to the operation of the engine by a conventional cam mechanism (not shown). The high voltage pulses generated in the secondary of the spark coil 12 upon opening of the breaker points 14 are provided to the spark plugs 18, associated with the engine cylinders, by a distributor 20 driven in timed relation to the rotation of the engine.

Signals from the primary circuit of the spark coil 12 are also provided to a counter 22 which sequentially applies triggering pulses to the various injector circuits in timed relation to the opening of the breaker points 14. This counter 22 is illustrated in my co-pending application Ser. No. 629,443 entitled "A Control Computer for a Fuel Injection System". The counter 22 sequences the actuation of the injectors.

The triggering pulses from the counter 22 are provided to a variable width pulse generator 24. The pulse generator 24 receives outputs from a plurality of engine sensors 25 which measure engine operating parameters, such as speed, temperature, manifold pressure, and the like, and control the width of the injector actuating pulse provided by the generator 24 each time it is triggered by a signal from the counter 22.

The output of the variable width pulse generator 24 is provided to a constant current driver circuit 26 operative to supply current to the coil of a solenoid actuated injector 28. The injector 28 is normally closed and opens upon receipt of an actuating pulse from the driver 26. The injector 28 is supplied with fuel from a constant pressure source 30 so that the quantity of fuel metered to an associated engine cylinder by the injector 28 is a function of the time that the injector 28 is held opened by the pulse from the constant current drive circuit 26. The drive circuit 26 maintains the response time of the injector 28 relatively independent of incidental system variables, such as resistance variations of the injector coil resulting from temperature variations.

Figure 2:
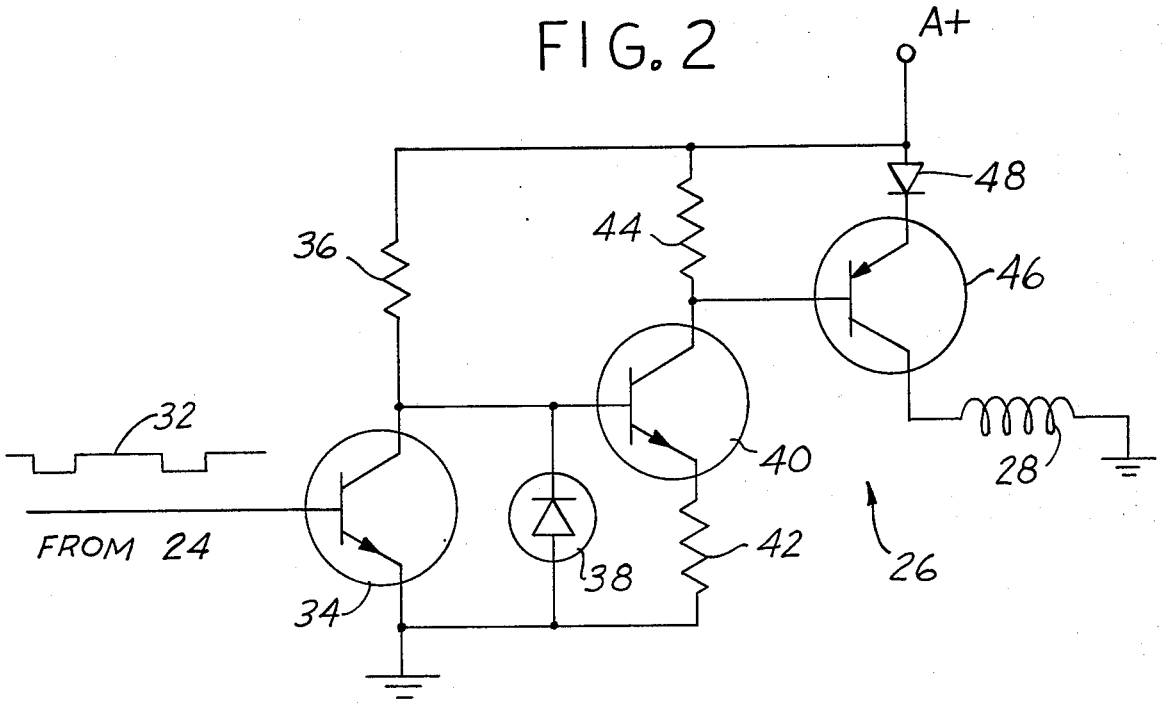
FIG. 2 is an electrical circuit diagram of the injector valve constant current source of my invention.

The detailed circuitry of the constant current drive circuit 26 is illustrated in FIG. 2. The variable width pulse generator 24 provides the circuit 26 with negative going pulses 32 of controlled width at regular intervals. These pulses are provided to the base of an NPN transistor 34 having its collector connected to the positive terminal of a power supply through a resistance 36. The transistor 34 has its emitter grounded. Transistor 34 is biased to be conductive in the absence of a negative going pulse 32 at its base. A Zener diode 38 is connected across the emitter-collector circuit of the transistor 34. The voltage at the collector of the transistor 34 is normally at ground and rises to the break-down voltage of the diode 38 when a negative pulse 32 at the base of the transistor 34 switches it into non-conduction.

The Zener diode limited voltage appearing at the collector of the transistor 34 is applied to the base of a second NPN transistor 40. The emitter of the NPN transistor 40 is connected to ground through a resistance 42. Its collector is connected to the positive terminal of the power supply through a resistance 44 and to the base of an output transistor 46. When the transistor 34 is switched into non-conduction, applying the regulated Zener voltage to the base of the transistor 40 the voltage across the resistance 42 rises to substantially the Zener voltage. The collector current of transistor 40 is substantially equal to its emitter current and both are highly stabilized by the action of Zener diode 38.

The collector current of transistor 40 is applied to the base of the PNP output transistor 46 having its collector connected to one end of the coil of the injector 28. The emitter of the transistor 46 is connected to the positive terminal of the power supply through a diode 48. In the absence of a relatively large current on the base of transistor 46, the diode 48 biases the transistor 46 into cut-off so that no current is applied to the solenoid coil of injector 28. When a negative going pulse 32 from the variable width pulse generator 24 cuts off the transistor 34 and provides a stabilized current to the base of the transistor 46, transistor 46 is driven into a proportional conductive current mode. The resultant collector of transistor 46 current flows through the coil of injector 28 and is precisely controlled as a function of the voltage of the Zener diode 38. When the negative going pulse 32 from the variable width pulse generator 24 terminates, the bias provided to the transistor 46 by the diode 48 drives transistor 46 sharply into non-conduction.

Figure 3:
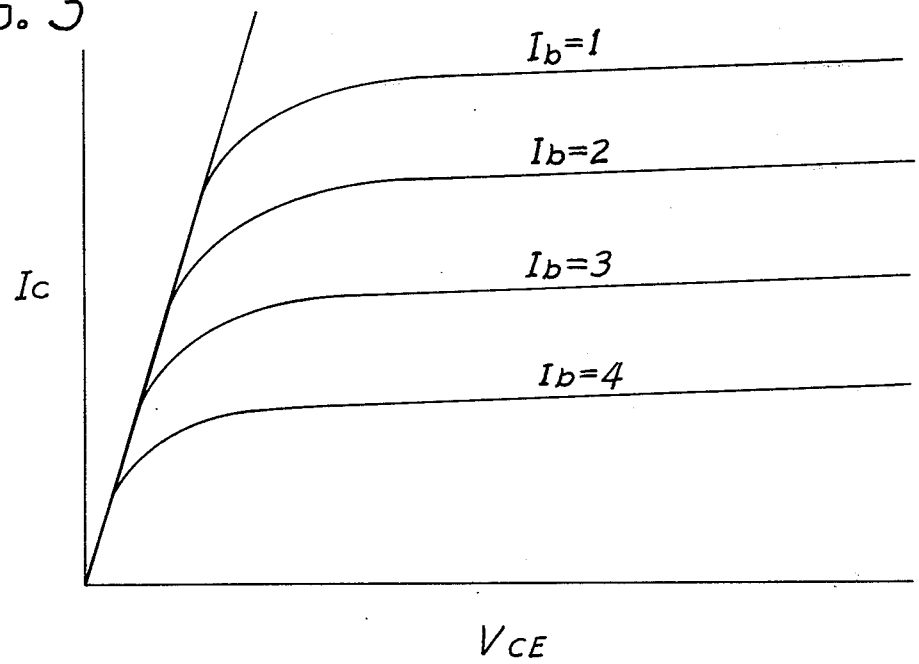
FIG. 3 is a plot of the characteristics of the output transistor in the constant current circuit of FIG. 2 illustrating the independence of collector current from load resistance.

FIG. 3 is a plot of typical operating characteristics for transistor 46, illustrating the substantial independence of the collector current from variations in the collector to emitter voltage as a function of a particular base current. The collector current is a function of base current and the collector-to-emitter voltage inherently varies in response to changes in the collector resistance caused by changes in impedance of the coil of injector 28 to maintain a constant current in the collector circuit. The transistor 46 acts as a constant current amplifier. With this configuration one end of the coil of injector 28 may be grounded.

Having thus described my invention, I claim:

1. For use in an internal combustion engine, an improved fuel injection system comprising at least one injector having an actuating coil and means for generating an actuating pulse to actuate said injector, wherein the improvement comprises:

(a) first semiconductor means having an input port adapted to receive said actuating pulse and an output port, said first semiconductor means being in a first state of conduction and adapted to change to a second state of conduction when said actuating pulse is received;

(b) reference means for establishing a stabilized reference voltage, said reference means being adapted to provide said reference voltage only when said first semiconductor means is in its second state of conduction and said reference means being connected to the output port of said first semiconductor means;

(c) second semiconductor means in a first state of conduction, said second semiconductor means having an input port connected to said reference means and an output port, and said second semiconductor means being responsive to said reference means such that said second semiconductor means changes to its second state of conduction when said reference means provides said reference voltage to the input port of said second semiconductor means;

(d) third semiconductor means in a first state of conduction, said third semiconductor means having an input port associated with the output port of said second semiconductor means and an output port associated with said coil of said injector, said third semiconductor means being responsive to said second semiconductor means such that when said second semiconductor means changes to its second state of conduction said third semiconductor means changes to its second state of conduction, thereby providing a predetermined actuating current to said coil of said injector, said current being essentially independent of variations in the impedance of said coil, the specific resistance of the wire used in said coil and the voltage supplied to the fuel injection system.

2. A fuel injection system as recited in claim 1, wherein each of said first, second and third semiconductor means comprises a transistor having base, collector and emitter electrodes; said reference means is a zener diode; and said output port of said first semiconductor means is the collector-emitter electrodes of said transistor of said first semiconductor means.

* * * * *